US008904666B1

(12) United States Patent
Rozell et al.

(10) Patent No.: US 8,904,666 B1
(45) Date of Patent: Dec. 9, 2014

(54) DRYER HAVING HYGIENIC PANELS

(75) Inventors: Keith Rozell, Cary, NC (US); Robert Warren, Cary, NC (US); Chris Giusto, Durham, NC (US)

(73) Assignee: Buhler Aeroglide Corporation, Raleigh, NC (US)

( * ) Notice: Subject to any disclaimer, the term of this patent is extended or adjusted under 35 U.S.C. 154(b) by 992 days.

(21) Appl. No.: 12/984,212

(22) Filed: Jan. 4, 2011

(51) Int. Cl.
*F26B 19/00* (2006.01)
*E04C 2/38* (2006.01)
*E04C 2/54* (2006.01)

(52) U.S. Cl.
USPC ..... 34/242; 52/656.4; 52/784.13

(58) Field of Classification Search
USPC ..... 34/232, 233, 242, 207, 216, 217, 603; 52/797.1, 800.12, 656.4, 656.2, 52/784.13, 784.1, 784.14–784.16, 788.1, 52/783.12, 783.1, 791.1, 794.1, 795.1, 20; 413/2, 4, 8; 220/4.21; 432/242; 126/190
See application file for complete search history.

(56) References Cited

U.S. PATENT DOCUMENTS

| | | | |
|---|---|---|---|
| 4,067,238 | A | 1/1978 | Oetiker |
| 4,246,462 | A | 1/1981 | Meisel |
| 4,344,975 | A | 8/1982 | Seiler |
| 4,775,542 | A | 10/1988 | Manser et al. |
| 4,830,866 | A | 5/1989 | Manser et al. |
| 5,026,567 | A | 6/1991 | Manser et al. |
| 5,101,717 | A | 4/1992 | Manser et al. |
| 5,199,184 | A | 4/1993 | Rosse |
| 5,293,814 | A | 3/1994 | Vorwerck et al. |
| 5,427,810 | A | 6/1995 | Vorwerck et al. |
| 5,456,931 | A | 10/1995 | Egger et al. |
| 6,136,353 | A | 10/2000 | Munz |
| 6,247,517 | B1 | 6/2001 | Drifka et al. |
| 6,374,510 | B1 | 4/2002 | Geissbuehler et al. |
| 6,595,765 | B1 | 7/2003 | Lengerich et al. |
| 6,895,687 | B2 | 5/2005 | Resch et al. |
| 7,069,255 | B1 | 6/2006 | Seiler et al. |
| 7,147,363 | B1 | 12/2006 | Wuest et al. |
| 7,150,892 | B2 | 12/2006 | Wuest et al. |
| 7,162,879 | B2 | 1/2007 | Hanimann et al. |
| 7,193,032 | B2 | 3/2007 | Culbert et al. |
| 7,481,007 | B2 | 1/2009 | Resch et al. |
| 7,683,156 | B2 | 3/2010 | Christel et al. |
| 7,819,942 | B2 | 10/2010 | Christel et al. |
| 2007/0164043 | A1 | 7/2007 | Lang et al. |

*Primary Examiner* — Kenneth Rinehart
*Assistant Examiner* — John McCormack
(74) *Attorney, Agent, or Firm* — Coast and Bennett PLLC

(57) ABSTRACT

A dryer for drying various types of products such as food products and pet food. The dryer includes a frame structure, a conveyor disposed in the dryer, and a heating unit for supplying heat to the dryer. A plurality of relatively lightweight hygienic panels, including doors, is secured to the frame structure and form a part of the exterior of the dryer. The hygienic panels provide access to the interior of the dryer for cleaning and maintenance. Each hygienic panel is sealed so that moisture and air cannot enter the interior of the panel. Disposed inside each hygienic panel is a honeycomb panel and an insulating structure. The hygienic panel provides rigidity and strength to the hygienic panel and at the same time enables the panel to be of a relatively light weight construction.

19 Claims, 7 Drawing Sheets

DRYER HAVING HYGIENIC PANELS

FIELD OF THE INVENTION

The present invention relates to thermal process system for drying, baking, cooking, and cooling various types of products. More particularly, the present invention relates to a dryer for drying products that includes hygienic or sanitary panels and doors.

BACKGROUND

Dryers such as the type manufactured and sold by Buhler Aeroglide Corporation are used to dry or thermally treat a wide variety of products, including food products and pet food, for example. These dryers are typically provided with detachable panels and doors that provide access to the interior of the dryer for cleaning and maintenance. One of the shortcomings of dryers of this type is that the removable panels and doors are heavy and do not always meet high hygienic standards. That is, the panels are not sealed and air and moisture can enter the interior of the panels or doors, resulting in the growth of bacteria.

Therefore, there has been and continues to be a need for a dryer design that is provided with hygienic or sanitary panels and doors that are sealed and which prevents moisture and air from entering the interior areas of the panels and doors.

SUMMARY

The present invention is a dryer comprising a frame structure, an interior conveyor or support for receiving and conveying product within the dryer, a heating unit for heating the dryer, and a plurality of hygienic panels, including one or more hygienic doors. Each panel is sealed so as to prevent moisture and air from entering the interior of the panel. In addition, each hygienic panel includes a front, back, and an interior area or space. Mounted in the interior space is a honeycomb panel that provides strength and rigidity to the hygienic panel, and an insulating structure disposed within the interior area of the hygienic panel.

In a particular embodiment, the honeycomb structure is secured to the front of the hygienic panel, and there is provided an interior or intermediate panel secured to a side of the honeycomb panel opposite the front of the hygienic panel. Disposed between the interior or intermediate panel and the back of the hygienic panel is an insulating structure.

In another particular embodiment, the hygienic panel includes a front panel and a back panel, and wherein each of the front and back panels include an overlapped outer edge, and wherein the overlapped outer edges of both front and back panels are abutted and connected together by a weldment that effectively seals the hygienic panel. The overlapped edges along with the weldment, form a connecting structure that enables hardware such as hinges or other connecting structure to be connected to the hygienic panel without penetrating the interior area of the panel.

Other objects and advantages of the present invention will become apparent and obvious from a study of the following description and the accompanying drawings which are merely illustrative of such invention.

DETAILED DESCRIPTION

With further reference to the drawings, the dryer of the present invention is shown therein and indicated generally by the numeral 10. Dryer 10 is a commercial or industrial dryer that is utilized to dry a wide variety of products, particularly food products such as cereal, grains, fruits and vegetables as well as animal food. Details of the dryer are not dealt with herein because such is not per se material to the present invention and because dryers of the type shown in FIG. 1 and discussed herein are well known and appreciated by those skilled in the art. For a more complete and unified understanding of the basic components of such conventional dryers, one is referred to the dryers that are presently being manufactured and sold by Buhler Aeroglide Corporation headquartered in Cary, N.C.

Figure 1:
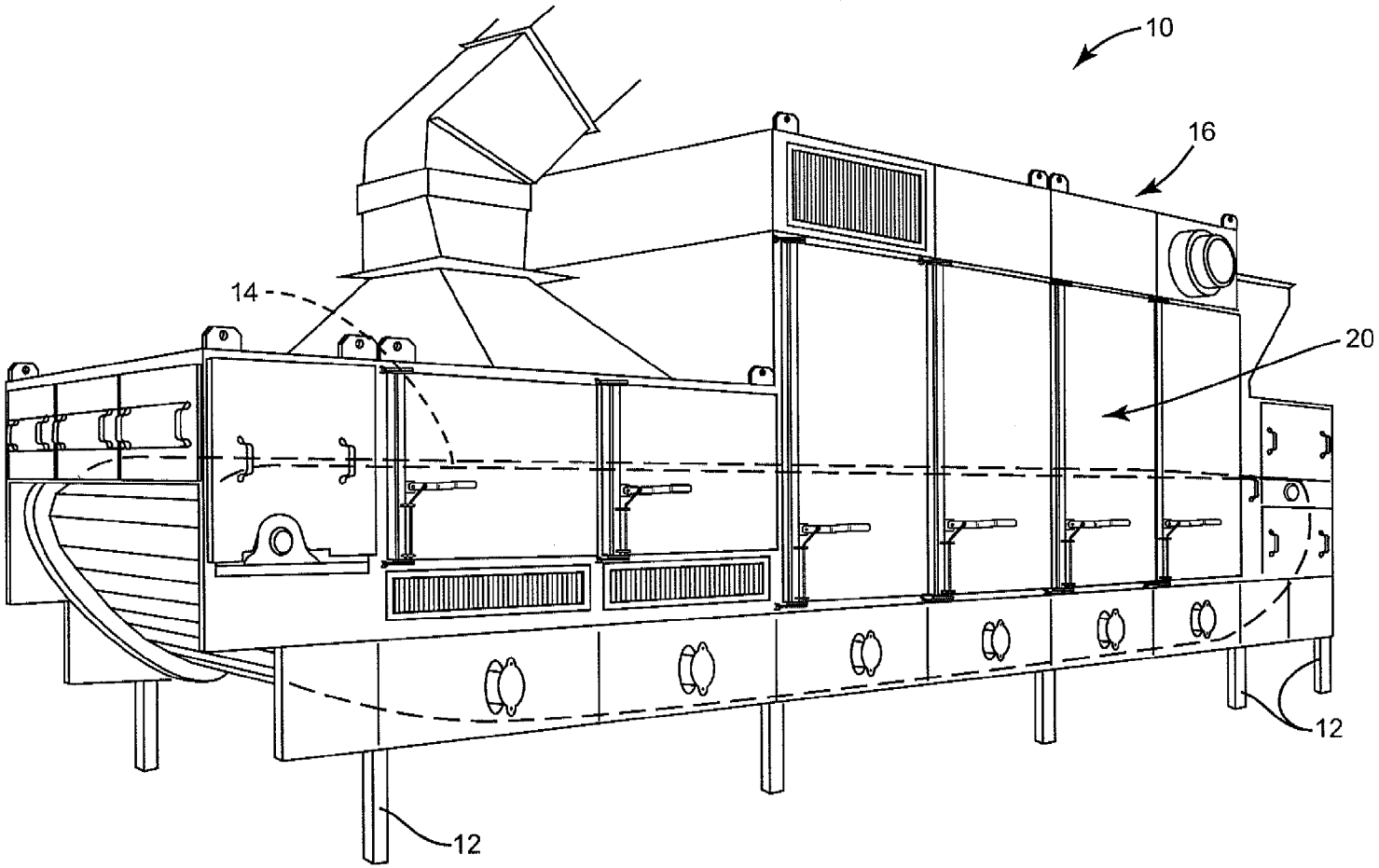
FIG. 1 is a perspective view of a dryer incorporating the hygienic door or panel of the present invention.
Figure 2:
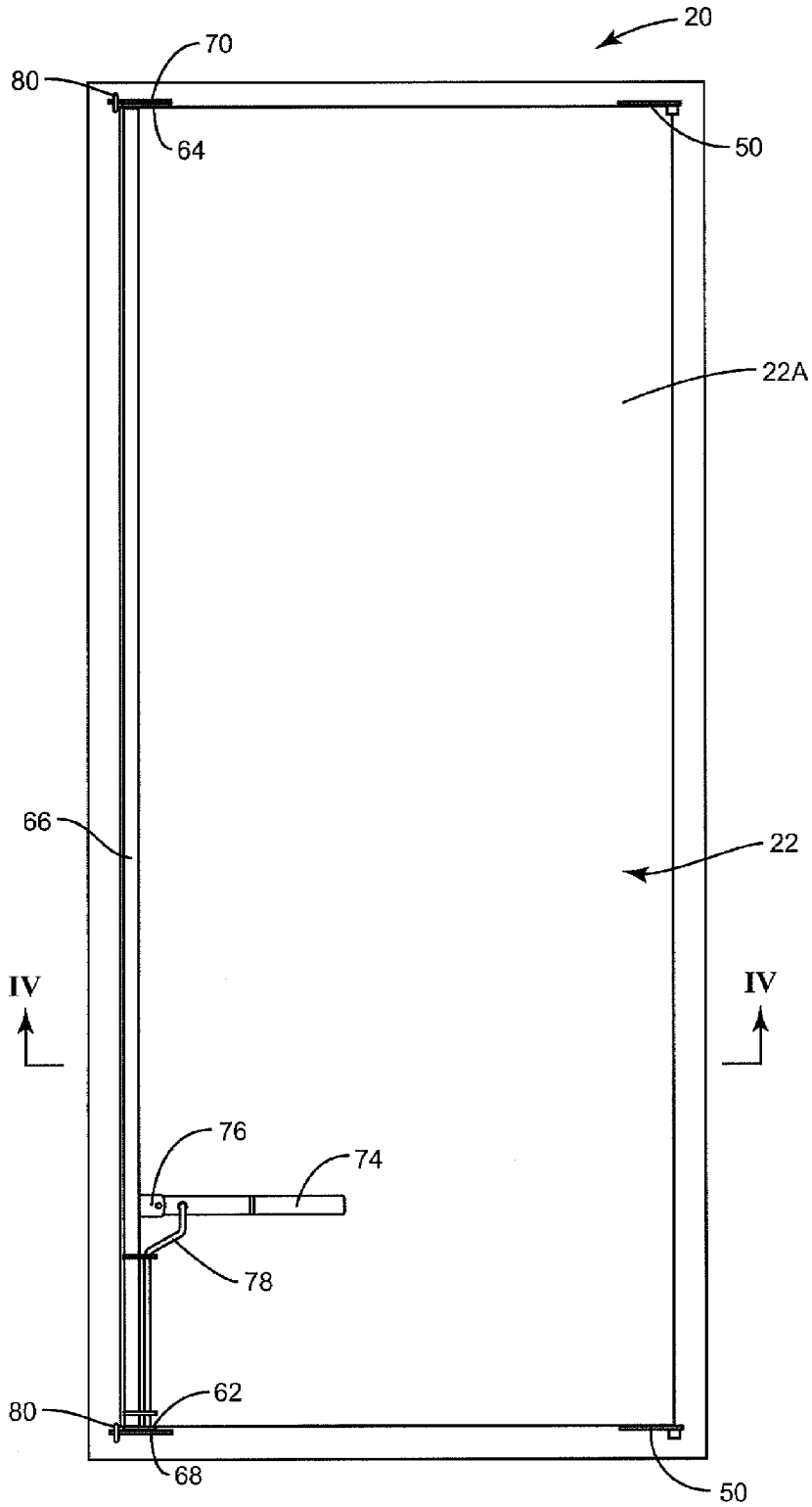
FIG. 2 is a front elevational view of the hygienic door.

In any event referring to the dryer 10, it should be noted that the same includes a frame structure 12 that supports the dryer and is utilized to support various components of the dryer. As seen in FIG. 1, dryer 10 includes an exterior surface that is typically partially made up of a combination of doors and panels. Defined within the anterior of the dryer 10 is an interior area for receiving products to be dried. There is provided inside the dryer a support structure for receiving and holding the product being dried. In the embodiment illustrated herein, the support structure includes an endless conveyor 14 that moves the product in a conventional fashion through the dryer. In addition, as shown in FIG. 1, dryer 10 includes a heating unit indicated generally by the numeral 16. Typically the heating unit includes one or more burners, such as gas burners, and one or more fans for directing air over the burners in order to heat the air. Thereafter the heated air is circulated in an appropriate fashion through the anterior area of the dryer 10 in order to dry the product therein.

As seen in FIG. 1, the dryer 10 includes one or more hygienic or sanitary doors or panels. The doors or panels function to enable access to the interior of the dryer 10 for inspecting products or for cleaning or performing maintenance. In the embodiment illustrated herein, the dryer includes mostly doors that can be opened for inspection and maintenance. It is understood and appreciated that the construction for the doors and panels are essentially the same except for the doors being provided with hardware that enables them to be swung open and closed. The panels on the other hand are provided with means to attach and detach them from the frame structure 12. In the following description, there will be a focus on the door but again it is understood that the panel would include the same basic structure in terms of the outer panels, interior construction, and how the outer panels are attached together.

With reference to FIGS. 2-5, one door of the dryer is shown therein and indicated generally by the numeral 20. This door is referred to as a hygienic or sanitary door. The term hygienic door or sanitary door means that the door is closed and sealed and that substantially no air is permitted to enter the interior of the door. This prevents bacteria from growing in interior areas of the door.

In the embodiment illustrated herein, door 20 includes a front panel indicated generally by the numeral 22 and a rear panel indicated generally by the numeral 24. Front and rear panels 22 and 24 are secured together in such a fashion that the inside area of the door, defined by the two panels 22 and 24, is generally airtight. Various materials, such as stainless steel, can be used for the front and back panels 22 and 24.

Figure 3:
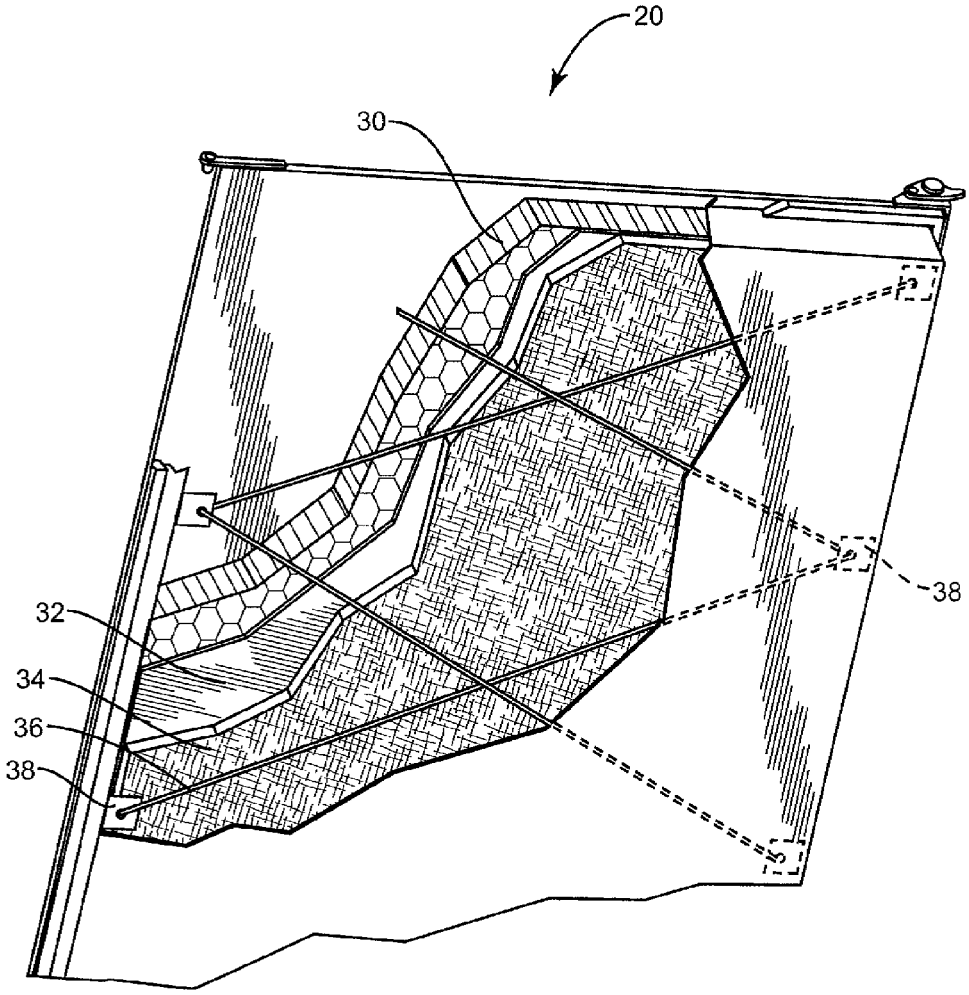
FIG. 3 is a fragmentary perspective view of the hygienic door with portions broken away to better illustrate the internal structure thereof.
Figure 4:
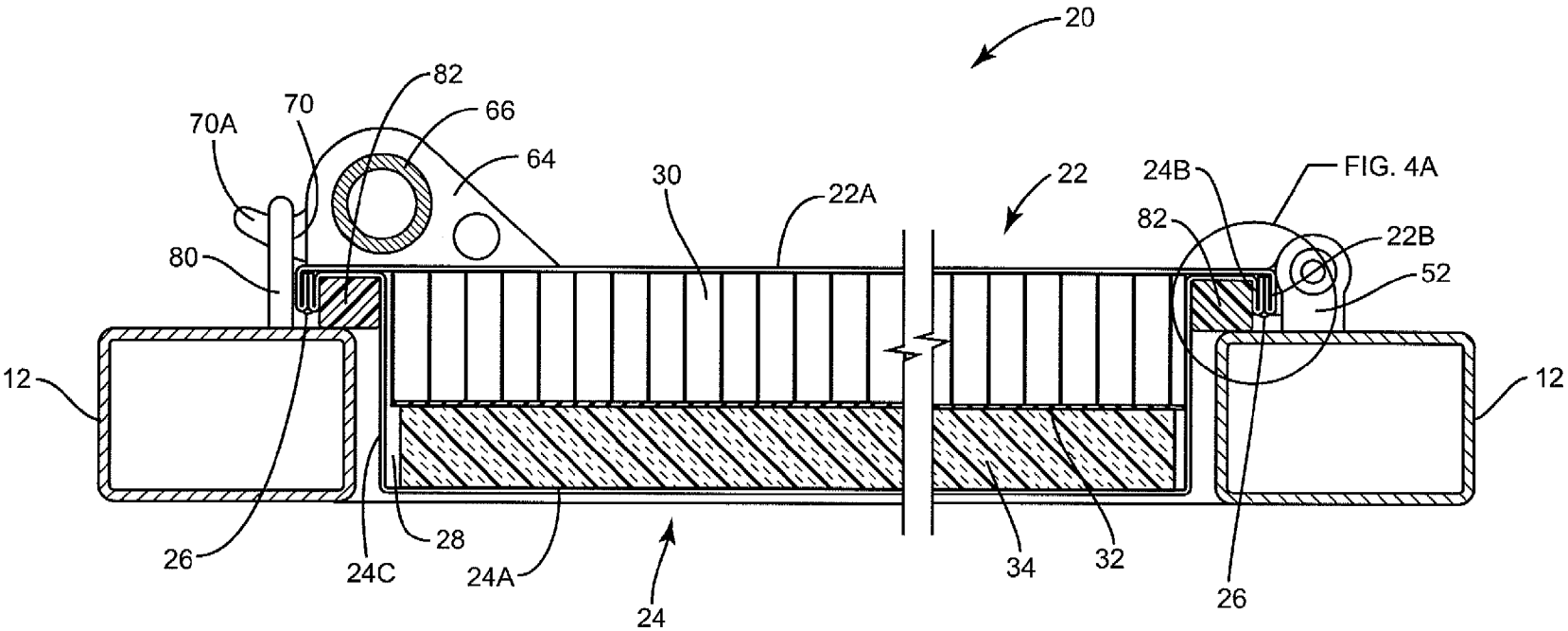
FIG. 4 is a view taken through the line IV-IV of FIG. 2.
Figure 4A:
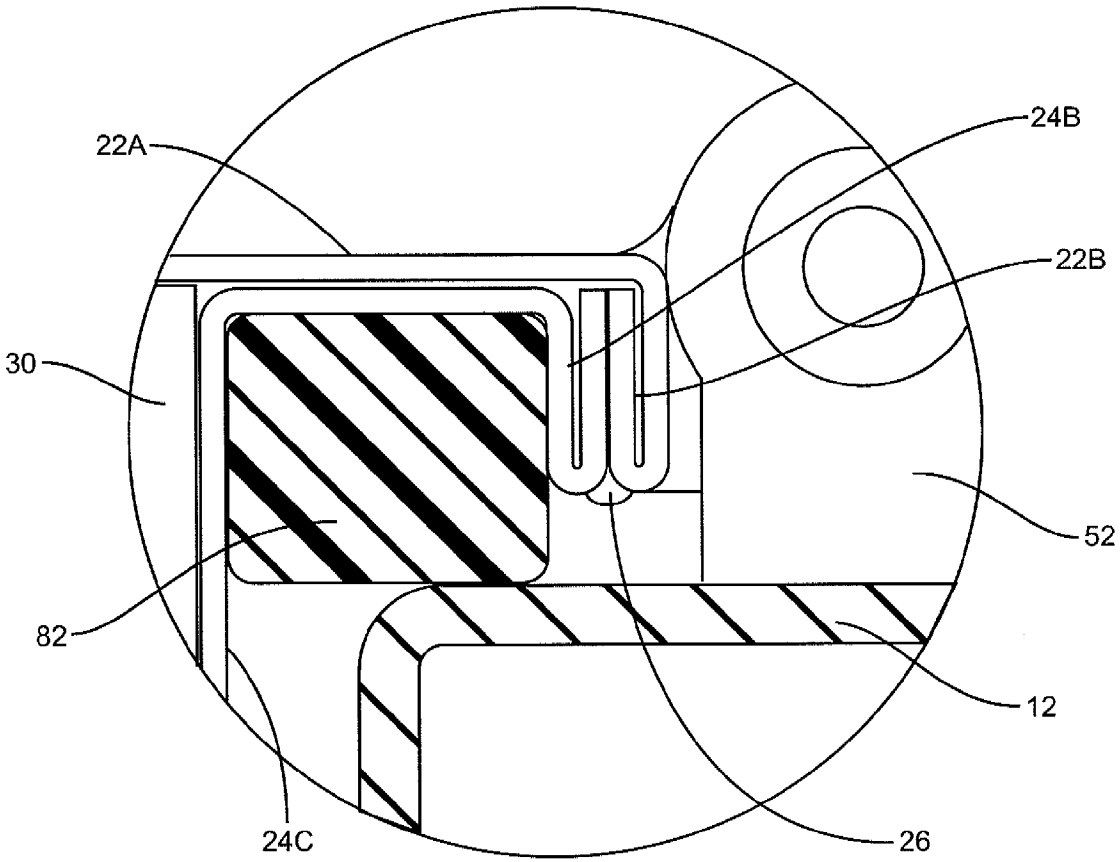
FIG. 4A is an enlarged view of the portion circled in FIG. 4.
Figure 5:
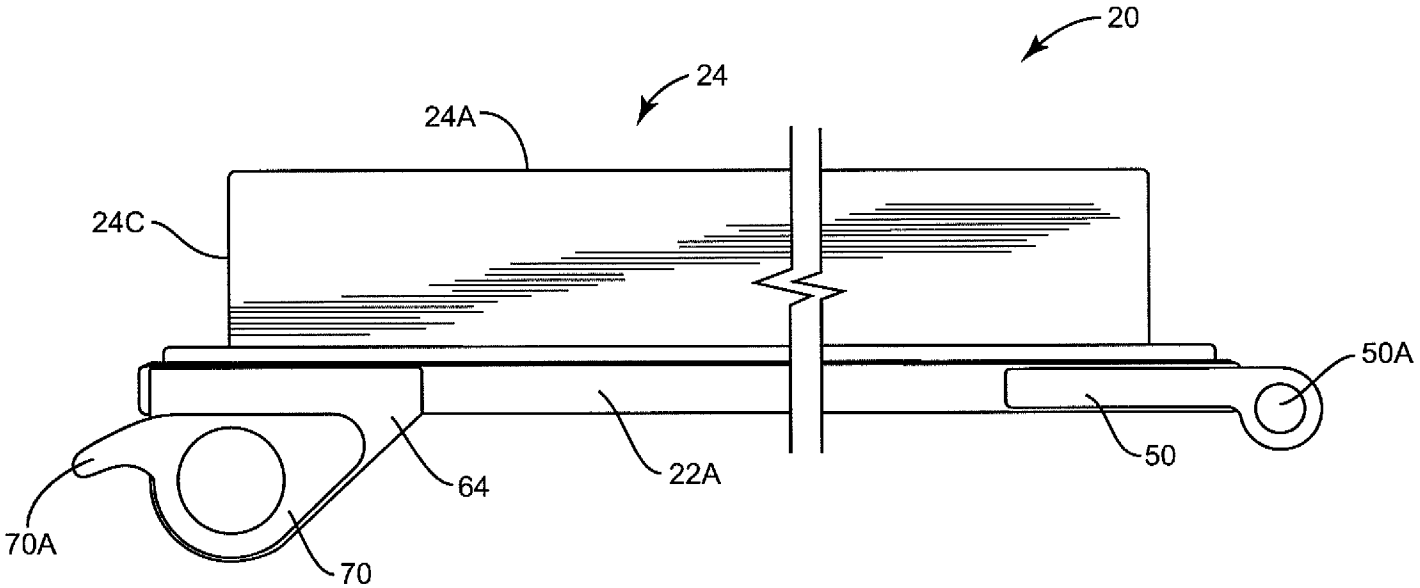
FIG. 5 is a top plan view of the hygienic door illustrating a hinged arm and a portion of a latching assembly.

FIGS. 3 and 4 show detailed views of how the front and back panels 22 and 24 are constructed and secured together as well as details of the interior design of the door 20. Note that the front panel 22 includes a front face 22A that is substantially planar. This is particularly illustrated in FIG. 4. Further front panel 22 includes a reinforced outer edge 22B. See FIG. 4A. In the case of this embodiment, the reinforced outer edge 22B is formed by folding a narrow outer strip of the front panel over a relatively narrow interior portion of the front panel. This effectively forms a two-ply construction around the edge of the front panel 22. Note that the two-ply construction or the reinforced outer edge 22B is turned at an angle of approximately 90 degrees with respect to the planar front face 22A. Thus as seen in FIGS. 4 and 4A, the reinforced outer edge 22B is at least twice as thick as the front face 22A.

Back panel 24 is of a similar construction. Back panel 24 includes a planar back portion 24A. In addition back panel 24A includes a pair of side portions 24C that extend inwardly towards the front panel 22 at an angle of approximately 90° with respect to the planar back portion 24A. Like the front panel 22, the back panel 24 includes a reinforced outer edge 24B. Reinforced outer edge 24B is constructed in similar fashion as the reinforced outer edge 22B of the front panel 22. Here again a relatively thin outer portion of the back panel 24 is folded over a relatively narrow portion of the back panel to form a two ply construction. Again the two ply construction that forms the reinforced outer edge 24B is at least two times as thick as the planar back portion 24A.

It should be appreciated that the reinforced outer edges 22B and 24B extend completely around the respective front and back panels 22 and 24.

Front and back panels 22 and 24 are secured together in such a fashion as to form a generally airtight seal. More particularly, the reinforced edges 22B and 24B are abutted together as shown in FIG. 4 and a weld seam 26 is utilized to secure the reinforced edges 22B and 24B together. More particularly, in this embodiment, the weld seam 26 is laid along an outer edge of the two reinforced edges 22B and 24B such that the weld seam engages both reinforced edges and effectively seals them. See FIG. 4A.

Front and back panels 22 and 24 form an open interior area indicated by the numeral 28. That is, there is defined a space that is bounded by the front and back panels 22 and 24.

Secured in the open space 28 is a honeycomb panel 30. Honeycomb panel 30 includes a multiplicity of open ended cells that extend generally perpendicular to the front and back panels 22 and 24. See FIGS. 3 and 4. Honeycomb panel 30 can be constructed of various suitable materials such as aluminum, titanium, graphite and ceramic materials. The honeycomb panel 30 is secured in the front or outside portion of the interior of the door 20. More particularly the honeycomb panel 30 is secured by glue to the back of the front face 22A. This is typically accomplished by utilizing a vacuum press. Secured to the other side of the honeycomb panel 30 is an intermediate panel 32 that is secured intermediately within the open space 28. One side of the honeycomb panel 30 is glued to the interior or intermediate panel 32. Again, the manner of securing the interior panel 32 to the honeycomb panel 30 can vary but in one embodiment an adhesive is utilized to secure the two components together. Various materials can be used for the interior panel 32. In one embodiment a phenolic sheet of material is utilized as the interior panel 32.

Honeycomb panel 30 adds rigidity and structural strength to the hygienic door 20. In addition because of the substantial air spaces that are found in the multiplicity of cells, the honeycomb 30 also serves as a thermal break.

Dispose on the interior side of the interior panel 32 is an insulation structure 34. Various types of insulation structures can be utilized but in this embodiment the insulation structure comprises a ceramic fiber blanket that is suspended by a stainless steel wire 36. More particularly, as viewed in FIG. 3, a series of clips 38 are secured to the interior panel 32 and the stainless steel wire 36 is attached to the respective clips and strung therebetween in a zigzag fashion while also being attached to the ceramic fiber blanket 34. Therefore, as viewed in FIGS. 3 and 4, the interior of the hygienic or sanitary door 20 includes the honeycomb panel 30 disposed about the outer portion of the door and the insulation structure 34 disposed about an inner portion of the door. The intermediate or interior panel 32 extends between the honeycomb panel 30 and the insulation structure 34.

Door 20 includes hardware for attaching it to the frame structure 12 of the dryer 10. In providing for the attachment of hardware to the door 20, the design implemented is a design where no fasteners project through the front and back panels 22 and 24 into the interior area of the door. This approach assists in providing a hygienic or sanitary door because by not providing such openings to the interior of the door it is possible to provide a design where the interior of the door is generally airtight. Therefore as will be discussed below, the hardware is secured to the mounting structure described above which is essentially the reinforced edges 22B and 24B which are in turn secured together by the weld seam 26.

Hardware utilized by the hygienic door 20 is shown in FIGS. 2, 4, 5, 6A and 6B. The hardware includes a pair of hinge arms 50 that are mounted to the top and bottom portions of the door 20 along one side. See FIG. 2. In this case, each hinge arm 50 is welded to the reinforced edges 22A and 22B. In particular, each hinge arm 50 is welded to the outermost reinforced edge which in the case of this design is the reinforced edge 22B of the front panel 22. While the hinge arms 50 might be welded directly to only one reinforced edge, it is the combined structure of the two reinforced edges 22B and 24B that provide structural support for the hinge arms 50 and the other attaching hardware. Note that each hinge arm 50 includes an opening 50A. See FIG. 5. Furthermore each hinge arm 50 is adapted or configured to attach to a hinge arm support 52 which is secured to a portion of the frame structure 12 and projects therefrom. See FIG. 4. A hinge pin interconnects each hinge arm support 52 and each hinge arm 50. This enables the hygienic door 20 to swing from an open position to a closed position.

Figure 6A:
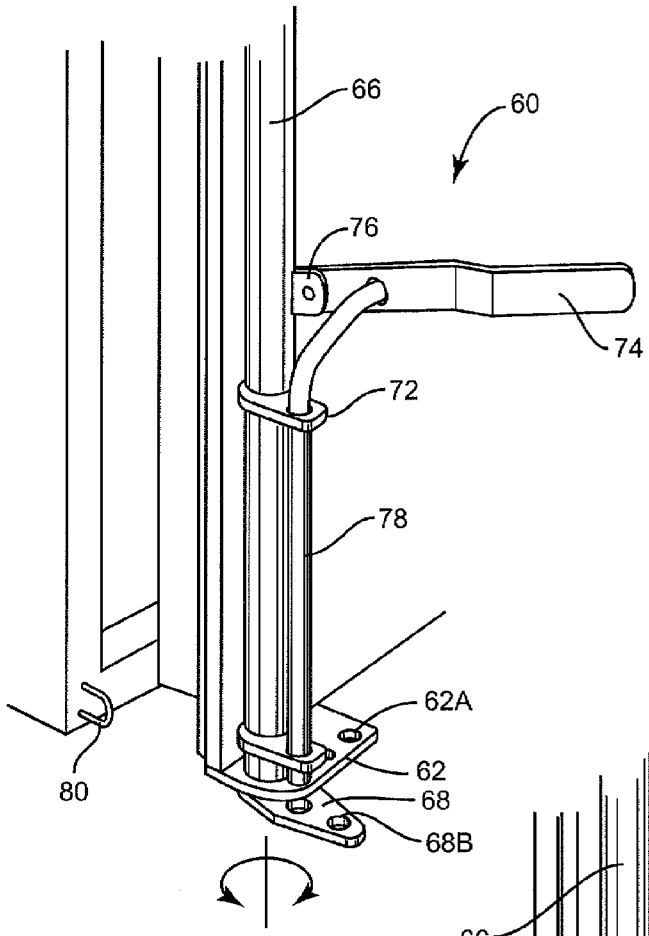
FIG. 6A is a fragmentary perspective view showing the latching assembly for the hygienic door in an unlatched position.
Figure 6B:
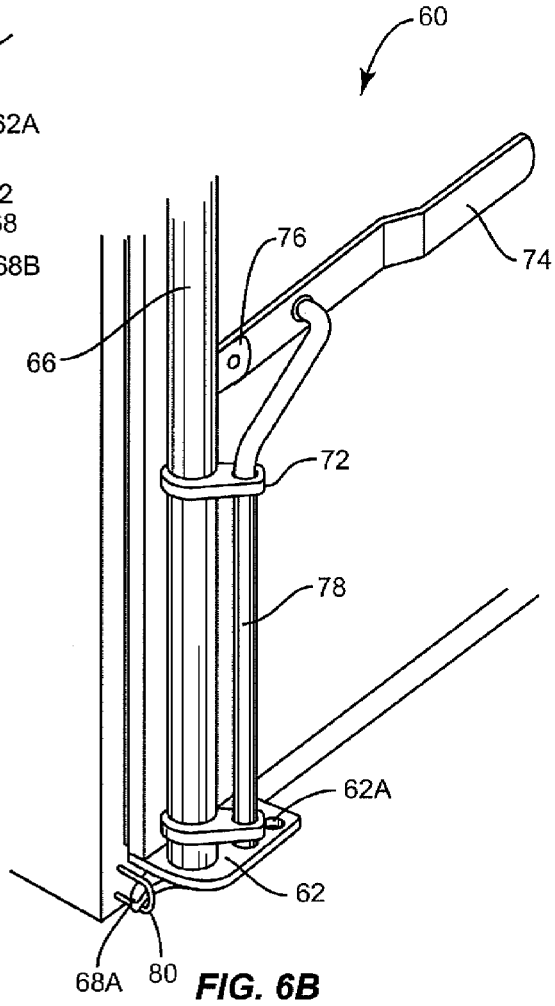
FIG. 6B is a view similar to FIG. 6A but showing the latching assembly in a latched position.

Mounted to the other side of the hygienic door 20 is a latching assembly indicated generally by the numeral 60. See FIGS. 6A and 6B. Latching assembly 60 includes a lower mounting plate 62 that also serves as a locking plate. Lower mounting plate 62 as viewed in FIGS. 6A and 6B is attached to the reinforced edges 22A and 22B by weldment. A series of opening 62A is provided in the lower mounting plate 62. There is also provided an upper mounting plate 64 that is secured to the hygienic door above the lower mounting plate 62. An actuating shaft 66 is rotatively journaled in the lower and upper mounting plates 62 and 64. Actuating shaft 62 is connected to a lower locking plate 68 that includes a series of opening 68B and a locking finger 68A. Secured to the upper portion of the actuating shaft 66 is an upper locking plate 70 that includes a locking finger 70A.

As seen in FIGS. 6A and 6B there is a locking pin carrier 72 fixed to the lower portion of the actuating shaft 66 and rotatable therewith. Further there is provided a handle 74 that is typically connected to a tab 76 that is fixed to the actuating shaft 66 and projects therefrom. A locking pin 78 is attached to the handle 74 and projects therefrom downwardly through openings in the locking pin carrier 72. Connected to the frame structure 12 adjacent where the upper and lower locking plate 68 and 70 reside is a pair of locking finger receivers 80. When the lower and upper locking plate 68 and 70 are disposed in the locked position as partially shown in FIG. 6B, the locking fingers 68A and 70B project into the locking finger receivers 80 so as to lock the hygienic door 20 in a closed and sealed position. Note in FIG. 4 the presence of the gasket 82 which forms a seal between the hygienic door 20 and the frame structure 12.

FIG. 6A shows the latching assembly in the unlatched position. To latch and/or lock the hygienic door 20, the door is closed and the handle is raised such that the locking pin 78 clears the lower locking plate 68. By rotating the handle 74 the lower locking plate 68 is rotated to where the locking finger 68A carried thereby engages and locks within the lower locking finger receiver 80 as shown in FIG. 6B. Now the handle 74 can be pressed down and this will cause the locking pin 78 to be inserted downwardly through a respective opening 62A in the lower mounting or locking plate 62. Now the hygienic door is firmly locked in the closed position and the seals 82 form a sealed relationship between the hygienic door 20 and the frame structure 12.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

The invention claimed is:

1. A dryer for drying a product comprising:

a. a frame structure;

b. a conveyor disposed in the dryer for receiving product and moving product through the dryer such that the product is dried as the product is moved along by the conveyor;

c. a heating unit associated with the dryer for providing heat to dry the product;

d. A plurality of hygienic panels forming at least a part of an exterior of the dryer, each hygienic panel comprising:

(i) a front and back comprised of at least two panels secured together, and an open interior area defined between the front and back;

(ii) a honeycomb panel disposed in the interior area of the hygienic panel for importing strength and rigidity to the hygienic panel;

(iii) an insulation structure disposed in the interior area of a hygienic panel;

(iv) an interior panel extending through the open interior area of hygienic panel and disposed between the honeycomb panel and the insulation structure;

(v) wherein the hygienic panel is sealed and is airtight such that air and moisture is prevented from entering the interior area of the hygienic panel; and (vi) an attaching structure attached to the exterior of the hygienic panel for attaching the hygienic panel to the dryer and wherein the attaching structure does not penetrate the hygienic panel and reach the open interior area of the hygienic panel.

2. The dryer of claim 1 wherein the front and back of the hygienic panel includes a front panel and a back panel with each front and back panel including a folded-over double ply surrounding edge; and wherein the folded-over double ply surrounding edges of the front and back panels are abutted together and wherein there is a weld seam securing together the folded-over double ply surrounding edges of the front and back panels.

3. The dryer of claim 2 wherein the folded-over double ply edges of the front and back panels form a mounting structure for the hygienic panel; wherein the attaching structure of the hygienic panel is attached to the mounting structure formed by the folded-over double ply edges of the front and back panels.

4. The dryer of claim 1 wherein the honeycomb structure is sandwiched between the back side of the front and the interior panel.

5. The dryer of claim 4 wherein the honeycomb structure is secured to the back side of the front and is further secured to the interior panel that extends through the open interior area of a hygienic panel.

6. The dryer of claim 1 wherein the insulation structure within the hygienic panel comprises a ceramic fiber blanket that extends across a substantial cross sectional area of the hygienic panel.

7. The dryer of claim 6 including a connecting line for connecting to the ceramic fiber blanket and suspending the ceramic fiber blanket in the open interior area of the hygienic panel.

8. The dryer of claim 1 wherein the honeycomb panel is constructed of aluminum, titanium, graphite, or ceramic material.

9. The dryer of claim 1 wherein the interior panel comprises a phenolic sheet that is secured to one side of the honeycomb structure.

10. The dryer of claim 1 wherein the honeycomb panel comprises an aluminum honeycomb panel sandwiched between a back side of the front of the hygienic panel and the interior panel which comprises a sheet of material having a thickness less than the thickness of the aluminum honeycomb panel.

11. The dryer of claim 1 wherein at least one of the hygienic panels includes a hygienic door that is hingedly mounted to the frame structure of the dryer and movable between a closed position and an open position.

12. A dryer for drying a product comprising:

a. a frame structure;

b. a support disposed in the dryer for receiving and supporting a product to be dried;

c. a heating unit associated with the dryer for providing heat to dry the product;

d. at least once hygienic door associated with the dryer for permitting access to an interior area of the dryer, the hygienic door comprising:

(i) a front panel;

(ii) a back panel;

(iii) a welded-edged seam securing the front and back panels together and hygienically sealing the door;

(iv) an open space defined between the front and back panels;

(v) a honeycomb panel secured in the open space between the front and back panels, the honeycomb panel including a multiplicity of cells that extend in a direction generally perpendicular to the front and back panels of the door; and (vi) an interior panel disposed in the open space between the front and back panels of a hygienic door, the interior panel secured to one side of the honeycomb panel and wherein the honeycomb panel is sandwiched between the interior panel and the front or back panel of a hygienic door.

13. The dryer of claim 12 wherein the front and back panels include reinforced outer edges and wherein the reinforced outer edges of the front and back panels are abutted together, and wherein the welded seam extends along the abutted reinforced edges of the front and back panels and secures the reinforced edges together.

14. The dryer of claim 13 wherein the reinforced edges of the front and back panels are at least twice as thick as interior portions of the front and back panels.

15. The dryer of claim 13 wherein the back panel includes:

a. a planar or back portion;

b. a pair of side portions that extend generally perpendicular to the planar or back portion; and c. wherein the side portions extend between the planar back portion and the reinforced edge of the back panel.

16. The dryer of claim 13 wherein the reinforced edges of the front and back panels form a mounting structure; and wherein the hygienic door includes at least one hinge arm and at least latching assembly, and wherein both the hinge arm and the latching assembly are secured to the mounting structure formed by the reinforced edges of the front and back panel.

17. The dryer of claim 12:

a. wherein the honeycomb panel is sandwiched between the back side of the front panel and the interior panel; and b. wherein the hygienic door includes an insulating structure disposed in the open space of a hygienic door between the interior panel and an interior side of the back panel.

18. The dryer of claim 12 wherein the hygienic door includes an exterior latching assembly that comprises:

a. a rotating elongated shaft that extends along one side of the front panel;

b. upper and lower locking fingers secured to upper and lower portions of the elongated shaft; and c. a handle secured to the elongated shaft and operative to rotate the elongated shaft between latched and unlatched positions wherein in the latched position, the upper and lower locking fingers project into receivers mounted on the dryer adjacent the hygienic door.

19. The dryer of claim 18 wherein the latching assembly further includes a locking plate secured to the front panel of the hygienic door and wherein the locking plate includes a plurality of openings; a locking pin operatively connected to the handle and moveable up and down between locked and unlocked positions, and wherein in the locked position, the locking pin extends into one of the openings of the locking plate.

* * * * *